US008156717B2

(12) United States Patent
Jørgensen

(10) Patent No.: US 8,156,717 B2
(45) Date of Patent: Apr. 17, 2012

(54) METHOD AND APPARATUS FOR WRAPPING A STACK WITH A WRAPPING SHEET

(75) Inventor: Kristian Jørgensen, Horsens (DK)

(73) Assignee: Schur Packaging Systems A/S, Horsens (DK)

( * ) Notice: Subject to any disclaimer, the term of this patent is extended or adjusted under 35 U.S.C. 154(b) by 204 days.

(21) Appl. No.: 12/448,444

(22) PCT Filed: Dec. 20, 2007

(86) PCT No.: PCT/DK2007/000557

§ 371 (c)(1),
(2), (4) Date: Feb. 3, 2010

(87) PCT Pub. No.: WO2008/074325

PCT Pub. Date: Jun. 26, 2008

(65) Prior Publication Data

US 2010/0139218 A1 Jun. 10, 2010

(30) Foreign Application Priority Data

Dec. 20, 2006 (DK) ..... 2006 01682

(51) Int. Cl.
*B65B 27/08* (2006.01)
*B65B 11/08* (2006.01)

(52) U.S. Cl. ..... 53/397; 53/466; 53/580; 53/228; 53/389.1

(58) Field of Classification Search ..... 53/397, 53/461, 465, 466, 580, 209, 210, 220, 228, 53/389.1; *B65B 11/08, 27/08*
See application file for complete search history.

(56) References Cited

U.S. PATENT DOCUMENTS

| | | | | | |
|---|---|---|---|---|---|
| 1,336,549 | A | * | 4/1920 | Anderson | 53/389.1 |
| 1,553,799 | A | * | 9/1925 | Beam | 53/389.1 |
| 1,583,395 | A | | 5/1926 | Davidson | |
| 2,109,527 | A | * | 3/1938 | Fenton | 53/228 |
| 3,125,841 | A | * | 3/1964 | Anderson | 53/228 |
| 3,996,728 | A | | 12/1976 | Gentili | |
| 4,021,993 | A | | 5/1977 | Widmer | |
| 4,698,952 | A | * | 10/1987 | Oberdorf | 53/389.1 |
| 5,009,055 | A | | 4/1991 | Simmons | |
| 5,189,865 | A | | 3/1993 | Andrade | |
| 5,522,297 | A | | 6/1996 | Enserink | |
| 6,164,040 | A | * | 12/2000 | Bowman, Jr. et al. | 53/389.1 |

(Continued)

FOREIGN PATENT DOCUMENTS

BE 664859 10/1965

(Continued)

*Primary Examiner* — Stephen F Gerrity
(74) *Attorney, Agent, or Firm* — James Creighton Wray

(57) ABSTRACT

A method and an apparatus for wrapping a stack (12, 13) of superposed sheets, brochures and/or folders with a wrapping sheet (15). The stack (13) is travelling in a first direction (4) on a first conveyor (2) defining a conveying path. A supply of wrapping sheets (14) is placed in line with the first conveyor (2). At the downstream end of the first conveyor (2) a rotating waver wheel (10) is arranged. This waver wheel pulls a top sheet (15) from the supply of wrapping sheets (14) and turns the wrapping sheet (15). Downstream of the first conveyor (2) a second conveyor (3) is provided defining a gap (5) between the first and second conveyors in which the wrapping sheet is inserted. As the stack (13) engages the wrapping sheet (15), the rotating waver wheel (10) folds the sheet around the stack.

8 Claims, 3 Drawing Sheets

U.S. PATENT DOCUMENTS

| | | | | |
|---|---|---|---|---|
| 6,640,522 | B2 * | 11/2003 | Antoniazzi et al. | 53/466 |
| 2003/0167736 | A1 | 9/2003 | Cinotti | |

FOREIGN PATENT DOCUMENTS

| | | | |
|---|---|---|---|
| EP | 0795472 | A1 | 9/1997 |
| EP | 1227040 | A1 | 7/2002 |
| EP | 1216922 | B1 | 12/2005 |
| EP | 1216923 | B1 | 3/2006 |
| NL | 9300006 | | 8/1994 |
| NL | 9300006 | A | 8/1994 |
| WO | 93/14490 | | 7/1993 |
| WO | 03/008273 | A1 | 1/2003 |

* cited by examiner

METHOD AND APPARATUS FOR WRAPPING A STACK WITH A WRAPPING SHEET

This application claims the benefit of Danish Application No. PA 200601682 filed Dec. 20, 2006 and PCT/DK2007/000557 filed Dec. 20, 2007, which are hereby incorporated by reference in their entirety.

FIELD OF THE INVENTION

The present invention relates to a method and an apparatus for wrapping a stack with a wrapping sheet where the stack comprises one or more substantially superposed sheets, brochures and/or folders.

BACKGROUND OF THE INVENTION

For wrapping sheets, brochures and/or folders or bundles of such matter a folded film or sheet, hereinafter called wrapping sheet, is placed around the stack. The purpose of this is to create separate stacks comprising a number of different sheets, brochures and folders, e.g. advertisements which are used for domestic distribution where the wrapping sheet separates the brochures or advertising material which need to be distributed to each household. The task of wrapping the wrapping sheet around the stack may be regarded as relatively simple in that in essence the task is to wrap the sheet around the stack.

This problem may be solved in a purely manual effort in that historically the people distributing such matters prior to distribution assembled the bundles and wrapped the finished stacks by wrapping sheets. However, this process is very slow and very costly. For this purpose a number of automatic devices have been developed.

One example of such a device is applicant's prior patent published in WO 03/008273. This prior art document describes a wrapping apparatus and method where a stack of sheets is conveyed between two superposed conveyors, an upper conveyor and a lower conveyor. The upper conveyor comprises two separate conveyors arranged end to end, with a gap between them. The stack of sheets is placed on a wrapping sheet, which has previously been placed on the lower conveyor, so that the stack approximately cover one third to one half of the sheet and as the stack and wrapping sheet passes the gap between the upper conveyors a number of air nozzles arranged underneath the lower conveyor issues jets so that the wrapping sheet is forced upwards due to the air stream and the wrapping sheet will then engage the second upper conveyor which thereafter will fold the wrapping sheet along the upper side of the stack. In this manner a relatively fast method of wrapping stacks of separate sheets, brochures and or folders is provided.

One drawback, however, with the prior art device and method is the fact that the stack needs to be placed on the first conveyor on top of the wrapping sheet. If the stack is not placed correctly on top of the wrapping sheet, the wrapping induced by the air nozzles may not be correct so that the wrapping sheet is placed in an uneven manner around the stack of sheets, brochures and/or folders. This in turn leads to unevenness when the wrapped stacks are being conveyed on to e.g. a stacker or for manual handling Furthermore, the precise positioning of the stack on top of the wrapping sheet requires that the dispensers or machines further upstream from the wrapping station work in a very precise manner in order to position the stack of sheets, brochures and/or folders correctly on the wrapping sheet. Another drawback is the fact that when it comes to high speed conveying the stack placed on the wrapping sheet may have such a low coefficient of friction between the wrapping sheet and the stack that the acceleration on the conveyors may displace the stack in relation to the wrapping sheet so that an uneven wrapping is the result.

One further example of such a device is described in U.S. Pat. No. 5,009,055. This prior art document describes an apparatus for wrapping a moving bundle of newspapers with a wrapping paper on three sides. The apparatus includes two conveyers for moving the stack to be bundled along a conveying path. The wrapping mechanism is provided for in a gap between the two conveyers, and the wrapping paper is fed from a continuous roll at a predetermined feed rate in a path perpendicular to the conveying path. Means is provided to grip the wrapping material, and to guide the material upwardly so as to cause the wrapping material to wrap itself about the bundle. Means is provided to cut the wrapping material when a predetermined length has been dispensed. The guiding mechanism for gripping the material and feeding it upwardly is driven by a pneumatic cylinder. The rate of movement by the guiding mechanism shall be the same as the paper feed rate, and the operation of the guiding mechanism shall be sequenced according to the location of the stack and paper feed rate.

The method and devise provided for dispensing and positioning the wrapping material is complex and very sensitive to the correct timing of the feed rate and the operation of the pneumatic cylinders. The cylinders are working in a linear translation motion. Each cycle consist of an extraction and retraction of the cylinder. This includes the following detailed steps; acceleration, deceleration, stop, acceleration in reverse direction, deceleration, stop. Each individual step needs to be carefully timed to fit the feed rate of the wrapping material and the bundles. This causes the devise to have a longer set up time. The reliability will be low due to the complexity and parts count, and therefore down time due to maintenance is expected to be high. Furthermore, the productivity of the wrapper is limited, because the pneumatic cylinders are inactive during part of the cycle with respect to wrapping the bundles.

A further example of a device is described in NL 9300006. This prior art document describes an apparatus for wrapping a stack with a wrapping sheet, where the stack comprises one or more substantially superposed sheets, brochures and/or folders wherein a first and second conveyor arranged in line with each other, defining a conveying path, where a gap is present between the first and second conveyor, a wrapping sheet dispenser is superposed the gap, where the wrapping sheet dispenser comprises a rotating waver wheel, such that the waver wheel may position a wrapping sheet in the gap, where said sheets plane is perpendicular to and positioned in the stacks travelling direction. The device makes use of two separate sets of rolls between which the stack is advanced. These separate sets of rollers are a complex device and as mentioned in the above cited prior art this may lead to low reliability.

OBJECT OF THE INVENTION

It is therefore an object of the present invention to provide a method for wrapping a stack with the wrapping sheet as well as an apparatus for carrying out this method which alleviates the disadvantages of the prior art device.

DESCRIPTION OF THE INVENTION

The invention addresses this by providing a method for wrapping a stack with a wrapping sheet where the stack comprises one or more substantially superposed sheets, brochures and/or folders characterised in that:

a) the stack is travelling in a first direction on a first conveyor defining a conveying path and;

b) that a supply of wrapping sheets are placed in line with the first conveyor either above or below the conveyor, wherein;

c) a wrapping sheet supply mechanism is arranged at the downstream end of the first conveyor, which mechanism comprise a rotating waver wheel, that pulls a top sheet of the supply of wrapping sheets, turns the wrapping sheet such that the plane of the sheet is perpendicular to the travelling direction of the stack;

d) a second conveyor is provided downstream of the first conveyor, such that a gap between the first and second conveyors may accommodate at least a part of the sheet supply mechanism and/or the wrapping sheet;

e) the rotating waver wheel inserts the wrapping sheet in the gap;

f) as the stack engages the wrapping sheet arranged in the gap, the rotating waver wheel provides means for folding the sheet along a front side of the stack and at least parts of the upper and lower side faces of the stack.

The invention also provides an apparatus for wrapping a stack with a wrapping sheet, where the stack comprises one or more substantially superposed sheets, brochures and/or folders wherein a first and second conveyor arranged in line with each other, defining a conveying path, where a gap is present between the first and second conveyor, a wrapping sheet dispenser is superposed the gap, where the wrapping sheet dispenser comprises a rotating waver wheel, such that the waver wheel may position a wrapping sheet in the gap, where said sheets plane is perpendicular to and positioned in the stacks travelling direction characterised in that the waver wheel is arranged so that it provides means for folding the upper part of the wrapping sheet along the upper side of the stack due to the action of the waver wheel.

With this method and apparatus it is provided that the stack of brochures and/or folders, hereinafter referred to as the stack, is transported in a direction perpendicular to the plane of the wrapping sheet. By furthermore arranging the wrapping sheet in the proper position in relation to the stack's travelling path, for example such that the stack will engage the wrapping sheet approximately in the middle of the wrapping sheet and enhanced control of the position of the wrapping sheet in relation to the stack is ensured. This in turn provides the possibility to preform the wrapping sheet, for example by providing folding lines in the wrapping sheet or otherwise provide special features in the wrapping sheet which will require that the wrapping sheet is very accurately arranged on the stack. The use of a rotating waver wheel provides easy adjustment and timing compared to a linear translating pneumatic cylinder. Because the direction of movement is continuous and not constantly changing, there is no time of inactivity with respect to the dispensing cycle. Therefore the invention may be used in high rate production.

In a further advantageous embodiment of the invention a wrapping sheet stop or land is provided such that the inserted wrapping sheet will be held in the correct elevation in relation to the conveying path. Although the waver wheel may accurately position the sheet in the proper position relative to the stacks transport path, the wrapping sheet stop or land, makes it possible for the waver wheel to release contact from the sheet and prepare for placing the following wrapping sheet in the gap. The stop or land therefore makes it possible to either use a larger waver wheel, which in turn provides special advantages in relation to being able to provide grip or attachment means for the wrapping sheets, and/or rotate the waver wheel faster, such that an increase in productivity may be gained.

In a further advantageous embodiment of the method the wrapping sheets are arranged as a continuous row of sheets on a roll or in a magazine, and that the wrapping sheet supply mechanism comprises means for detaching, cutting or otherwise separate single wrapping sheets from the row.

The wrapping sheet supply mechanism may be a dispenser for dispensing separate sheets or may as suggested in this embodiment of the invention be an arrangement where the wrapping sheets are in the shape of a continuous feed, for example rolled up onto a roll, so that as the sheets are dispenses, the sheets are also cut from the roll.

The wrapping sheet dispenser will be arranged so that the mechanism arranging the wrapping sheet in the stack's path will be able to move and carry out the different functions in the gap provided between the first and second conveyors arranged in line. The waver wheel will engage the stack of wrapping sheets and guide the wrapping sheet down into its proper position perpendicularly to the conveying path provided by the first and second conveyors arranged in line. As the stack advances it will engage the wrapping sheet brought into position by the rotating waver wheel, but in order to assure that the wrapping sheet is in its correct position relative to the stack a wrapping sheet land as foreseen in a further advantageous embodiment is provided so that as the waver wheel pulls a wrapping sheet from the dispenser and arranges this wrapping sheet perpendicularly to the travelling direction of the stack, the wrapping sheet will be placed correctly in the gap by having the waver wheel move the wrapping sheet into contact with the wrapping sheet land, which will thereafter determine the correct positioning of the wrapping sheet in relation to the conveying part. This in turn means that by adjusting the distance between the conveying path and the wrapping sheet land it is possible to adjust the positioning of the wrapping sheet in relation to the stack to be wrapped.

In a further advantageous embodiment of the invention height adjustable secondary conveyors are positioned above and in line with the first and second conveyors, and that the secondary conveyors are separated by a corresponding or larger gap as the first and second conveyors.

This embodiment is particularly useful for high-speed applications where it is desirable to accelerate the stack of superposed sheets as rapidly as possible along the conveying path. By engaging the stack both from below and from above a certain pressure will be introduced into the stack so that even at relatively high speeds no disc configuration of the stack will occur due to accelerations or other impacts. The secondary conveyors in this manner serve to maintain the integrity of the stack during the conveying. Furthermore, the second conveyor arranged downstream from the gap will fold the wrapping sheet in the same manner as the first conveyor downstream of the gap along the top side and lower side of the stack respectively and thereby complete the positioning of the wrapping sheet around or at least in contact with the stack. With this embodiment where height adjustable secondary conveyors are provided, the ability of the waver wheel to separate a single wrapping sheet from the wrapping sheet dispenser and place it in contact with the wrapping sheet land in a orientation perpendicular to the transport direction of the stack is the determining factor in how quickly the wrapping procedure may be completed.

In order to further improve this, the invention in a further advantageous embodiment provides that the waver wheel is provided with at least one suction nozzle. As the waver wheel constantly rotates preferably at a constant speed, activation of a suction nozzle will increase the probability of attaching a wrapping sheet to the waver wheel and thereby arranging it perpendicularly to the stack's transport direction. The suction nozzles may be connected to a source of vacuum which may incorporate a very quick-acting valve so that the suction may be applied and terminated very rapidly in order for waver wheel to attach itself to a wrapping sheet, pull it from the dispenser and into the gap and cut-off section in order to let the wrapping sheet lose and engage the wrapping sheet land for correct positioning in the gap in a relatively short time corresponding to the time it takes a stack to travel past the wrapping station.

DESCRIPTION OF THE DRAWING

The invention will now be explained with reference to the accompanying drawing wherein

In FIG. 1 is illustrated a schematic representation of an apparatus 1 according to the invention.

Figure 1:
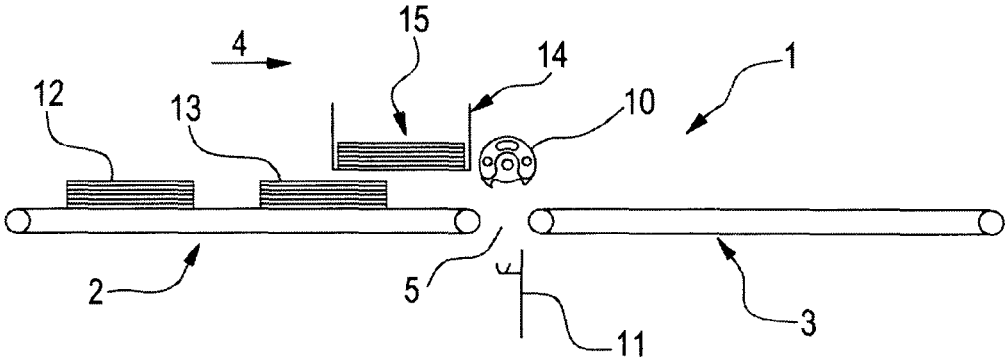
FIG. 1 illustrates a schematic apparatus according to the invention.

The apparatus comprises two conveyors, a first conveyor 2 and a second conveyor 3 arranged downstream of the first conveyor.

Upstream and downstream are in relation to the intended transport direction indicated by the arrow 4.

Between the first and second conveyors 2, 3 is arranged a gap 5. Adjacent the gap is arranged a waver wheel 10 and a wrapping sheet land 11.

Furthermore, as indicated by 12 and 13, two stacks of folded brochures are travelling on the first conveyor 2 towards the gap 5.

Figure 2:
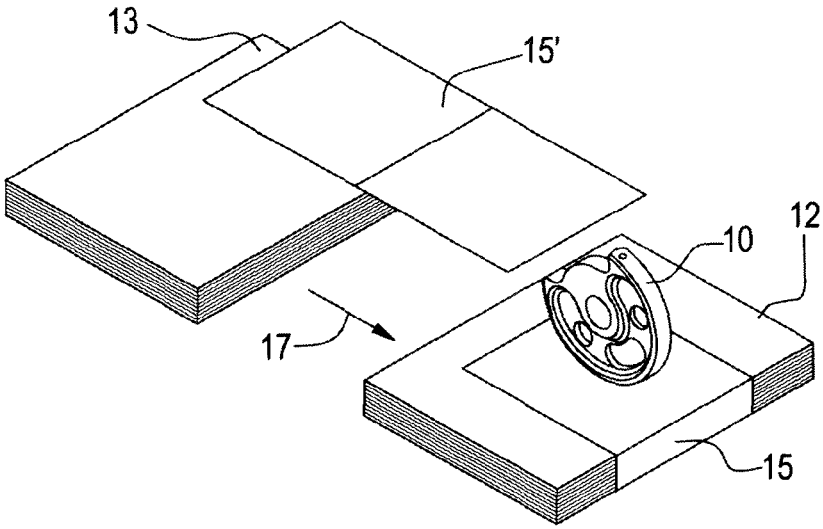
FIGS. 2, 3, 4 and 5 illustrate details relating to the waver wheel.
Figure 2A:
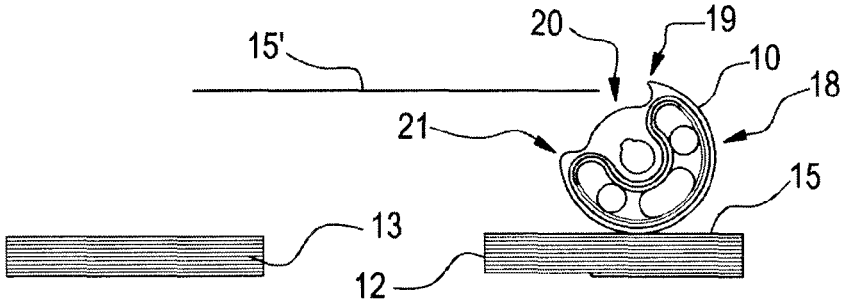
Figure 3:
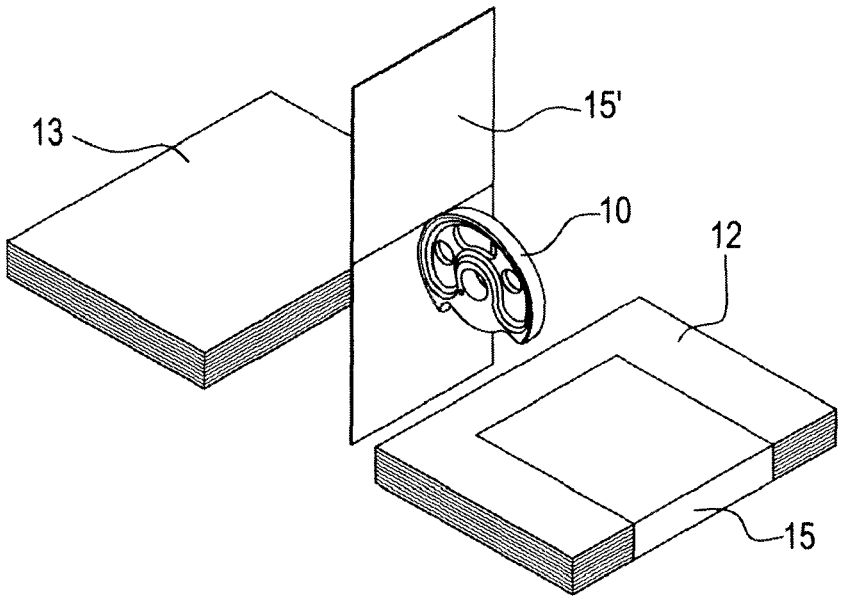
Figure 3A:
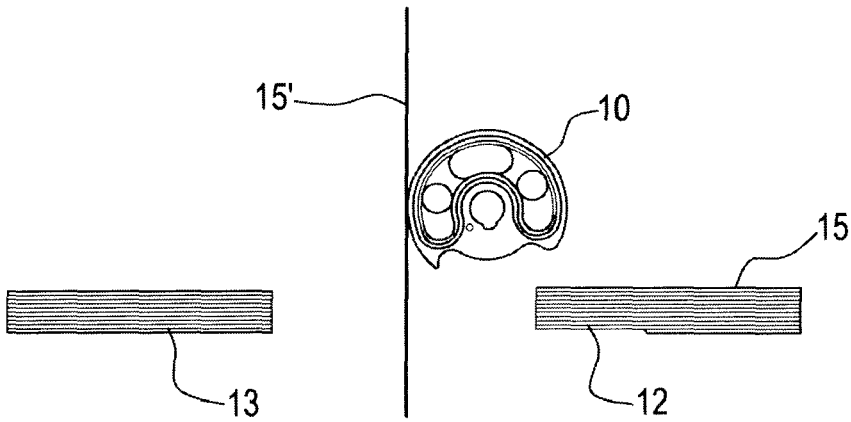

FIG. 2*a* shows a section view of the rotating waver wheel 10. The rotating waver wheel 10 has a circular part 18 extending about three quarters around the circumference. The purpose of this part of the rotating waver wheel is to move the wrapping sheet 15 into position and to fold it on top of the stacks 12. The remaining part 20 of the rotating waver wheel 10 has a smaller diameter and an edge 19 at one end, which is especially adapted for gapping the wrapping sheet 15, and a rounded off shape 21 at the other end in order not to leave marks on the wrapping sheet 15.

The waver wheel 10 is arranged in connection with a wrapping sheet dispenser 14 so that wrapping sheets 15 arranged in the dispenser 14 may be transported by the waver wheel 10 into a substantially perpendicular direction in relation to the transport direction 4 of the stacks 12, 13 and into contact with the wrapping sheet land 11. Therefore, a wrapping sheet 15 will be placed perpendicularly to the travelling direction 4 in the gap 5, and as the first stack 13 engages the wrapping sheet, the wrapping sheet will be folded around the stack 13 as it travels on to the second conveyor 3.

The lower part of the wrapping sheet 15 will be folded along the underside of the stack 13, as it engages the second conveyor 3. The upper part of the wrapping sheet will be folded along the upper side of the stack 13 due to the action of the waver wheel.

Alternatively to folding the upper part of the wrapping sheet by means of the waver wheel a second conveyor arranged above the second conveyor 3 may be used to arrange the wrapping sheet in its proper position.

Turning to FIGS. 2-5 the particular function of the waver wheel will be explained in more detail. In FIG. 2 two stacks 12, 13 are illustrated. The first stack 12 has proceeded past the position in which the wrapping sheet 15 is inserted into the conveying path illustrated by the arrow 17. The stack 12 has thereby had a wrapping sheet 15 placed along the front end of the stack 12 as well as on the underside and upper side of the stack 12. The upper part of the wrapping sheet 15 is folded along the upper side of the stack 12 due to the waver wheel 10 engaging the upper side of the wrapping sheet and folding it along the upper side of the stack 12. As the next stack 13 proceeds in the direction 17 towards the gap (not illustrated) a further wrapping sheet 15' is pulled out of the dispenser and due to the action of the waver wheel 10 arranged substantially perpendicularly to the travelling direction 17 of the stack 13. As the stack 13 proceeds in the travelling direction 17, the lower part of the wrapping sheet 15' will due to the stack and wrapping sheet's engagement with the second conveyor 3 (not illustrated in FIG. 3, but depicted in FIG. 1) be folded along the underside of the stack 13 and due to the engagement of the wrapping sheet 15' with the waver wheel 10 the wrapping sheet will be folded along the upper side of the stack 13.

Figure 4:
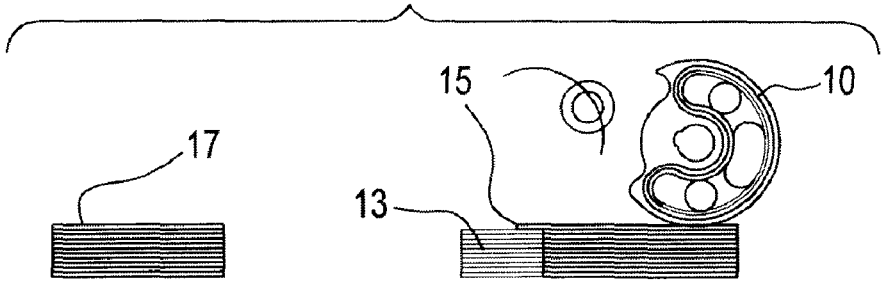

This may better be seen in FIG. 4, where a cross section through waver wheel and a stack is depicted. The stack 13 has at this stage engaged the wrapping sheet 15, and the action of the waver wheel is such that the wrapping sheet 15 has been folded along the upper side of the stack 13. The waver wheel will rotate, and as the stack 13 moves further in the travelling direction a new wrapping sheet will be engaged from the wrapping sheet dispenser 14, so that a situation with respect to the following stack 17 will be as illustrated with reference to FIG. 3. In this manner a continuous, fast and very reliable apparatus and method is provided for arranging wrapping sheets around a stack of printed material.

Figure 5:
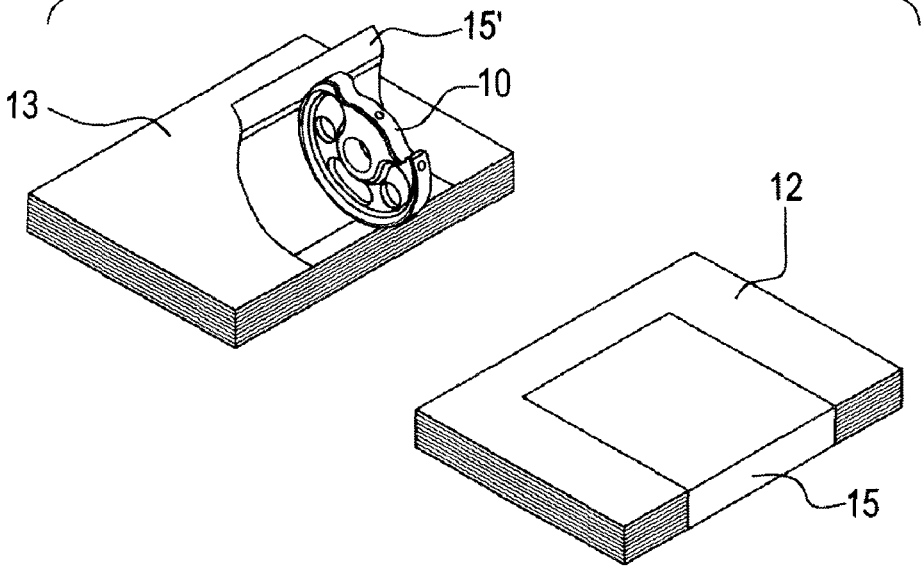
Figure 5A:
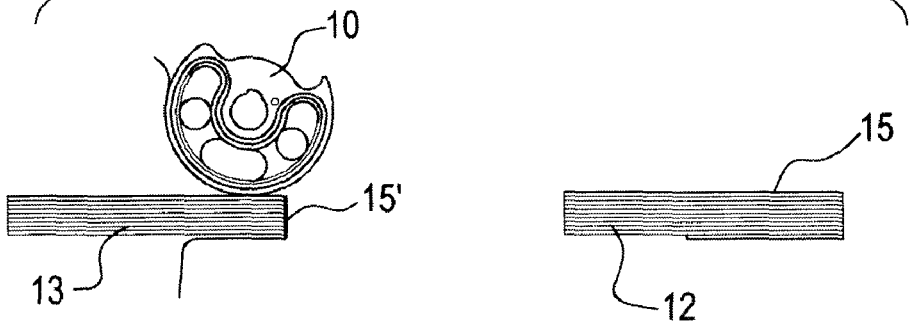

FIG. 5 shows the waver wheel 10 in a position prior to the position depicted in FIG. 4. The stack 13 has just engaged the wrapping sheet 15', and the waver wheel 10 has started to fold the wrapping sheet 15' on top of the stack 13.

The invention claimed is:

1. Method for wrapping a stack with a wrapping sheet, where the stack comprises one or more substantially superposed sheets, brochures and/or folders wherein:

a) the stack is travelling in a first direction on a first conveyor defining a conveying path and;

b) that a supply of wrapping sheets is placed in line with the first conveyor either above or below the conveyor, wherein;

c) a wrapping sheet supply mechanism is arranged at the downstream end of the first conveyor, which mechanism comprises a rotating waver wheel, that pulls a top wrapping sheet from the supply of wrapping sheets, turns the wrapping sheet such that the plane of the sheet is perpendicular to the travelling direction of the stack;

d) a second conveyor is provided downstream of the first conveyor, such that a gap between the first and second conveyors, may accommodate at least a part of the sheet supply mechanism and/or the wrapping sheet;

e) the rotating waver wheel inserts the wrapping sheet in the gap;

f) as the stack engages the wrapping sheet arranged in the gap, the rotating waver wheel provides means for folding the sheet along a front side of the stack and at least parts of upper and lower side faces of the stack.

2. Method according to claim 1 wherein the wrapping sheets are arranged as a continuous row of sheets on a roll or in a magazine, and that the wrapping sheet supply mechanism comprises means for detaching, cutting or otherwise separating single wrapping sheets from the row.

3. Method according to claim 1 wherein a wrapping sheet stop is provided such that the wrapping sheet inserted by the waver wheel will be held in the correct elevation in relation to the conveying path.

4. Apparatus for wrapping a stack with a wrapping sheet where the stack comprises one or more substantially superposed sheets, brochures and/or folders, a first and second conveyor arranged in line with each other, defining a conveying path, where a gap is present between the first and second conveyor, a wrapping sheet dispenser is superposed the gap, where the wrapping sheet dispenser comprises a rotating waver wheel, such that the waver wheel may position a wrapping sheet in the gap, where said sheet's plane is perpendicular to and positioned in the stacks travelling direction, wherein said waver wheel is arranged so that it provides means for folding an upper part of the wrapping sheet along an upper side of the stack due to the rotation of the waver wheel.

5. Apparatus according to claim 4 wherein a wrapping sheet land is provided on a side of the gap opposite to the dispenser in order to maintain the sheet in its correct position relative to the conveyors.

6. Apparatus according to claim 4 wherein height adjustable secondary conveyors are positioned above and in line with the first and second conveyors, and that the secondary conveyors are separated by a corresponding or larger gap as the first and second conveyors.

7. Apparatus according to claim 4 wherein the waver wheel is provided with at least one suction nozzle.

8. Apparatus according to claim 4 wherein the waver wheel rotates in a substantially constant manner, and with each rotation places a wrapping sheet in the gap between the first and second conveyors.

* * * * *